US005486241A

United States Patent [19]

Ushioda et al.

[11] Patent Number: 5,486,241

[45] Date of Patent: Jan. 23, 1996

[54] NON-AGING AT ROOM TEMPERATURE FERRITIC SINGLE-PHASE COLD-ROLLED STEEL SHEET AND HOT-DIP GALVANIZED STEEL SHEET FOR DEEP DRAWING HAVING EXCELLENT FABRICATION EMBRITTLEMENT RESISTANCE AND PAINT-BAKE HARDENABILITY AND PROCESS FOR PRODUCING THE SAME

[75] Inventors: Kohsaku Ushioda; Naoki Yoshinaga; Yoshikazu Matsumura; Osamu Akisue, all of Futtsu; Kunio Nishimura; Hidekuni Murakami, both of Kitakyusyu, all of Japan

[73] Assignee: Nippon Steel Corporation, Tokyo, Japan

[21] Appl. No.: 240,782

[22] PCT Filed: Sep. 14, 1993

[86] PCT No.: PCT/JP93/01314

§ 371 Date: Jun. 29, 1994

§ 102(e) Date: Jun. 29, 1994

[87] PCT Pub. No.: WO94/06948

PCT Pub. Date: Mar. 31, 1994

[30] Foreign Application Priority Data

| | | | |
|---|---|---|---|
| Sep. 14, 1992 | [JP] | Japan | 4-245306 |
| Sep. 14, 1992 | [JP] | Japan | 4-245307 |
| Jan. 20, 1993 | [JP] | Japan | 5-007817 |
| Mar. 19, 1993 | [JP] | Japan | 5-060782 |

[51] Int. Cl.[6] ..... C22C 38/06; C21D 8/02

[52] U.S. Cl. ..... 148/330; 148/603; 148/661; 148/651

[58] Field of Search ..... 148/661, 603, 148/651, 330

[56] References Cited

U.S. PATENT DOCUMENTS

| | | | |
|---|---|---|---|
| 3,827,924 | 8/1974 | Takechi et al. | 148/326 |
| 5,078,809 | 1/1992 | Kinoshita et al. | 148/651 |

FOREIGN PATENT DOCUMENTS

| | | | |
|---|---|---|---|
| 405339 | 12/1993 | Japan | 148/651 |
| 434128 | 6/1974 | U.S.S.R. . | |
| 92 16668 | 10/1992 | WIPO . | |

*Primary Examiner*—Deborah Yee

*Attorney, Agent, or Firm*—Kenyon & Kenyon

[57] ABSTRACT

The present invention provides a non-aging at room temperature ferritic single-phase cold-rolled steel sheet or hot-dip galvanized steel sheet for deep drawing and having excellent fabrication embrittlement resistance and paint-bake hardenability, by heating a slab comprising, in terms of % by weight, 0.0001 to 0.0015% of C, not more than 1.2% of Si, 0.03 to 3.0% of Mn, 0.01 to 0.15% of P, 0.0010 to 0.020% of S, 0.005 to 0.1% of Al, 0.0001 to 0.0080% of N and 0.0001 to 0.0030% of B and optionally 0.1 to 3% of Cr with the balance consisting of Fe and unavoidable impurities, hot-rolling the heated slab at a finishing temperature of not lower than ($Ar_3$—100)° C., cooling the hot-rolled coil within 1 sec after the hot rolling at a rate of not less than 50° C./sec from the finishing temperature to a temperature in the range of from 600° to 750° C. and coiling the cooled strip in said temperature range, cold-rolling the coil with a reduction ratio of not lower than 60% and conducting continuous annealing or continuous hot-dip galvanizing in the temperature range of from 600° to 900° C.

14 Claims, 3 Drawing Sheets

NON-AGING AT ROOM TEMPERATURE FERRITIC SINGLE-PHASE COLD-ROLLED STEEL SHEET AND HOT-DIP GALVANIZED STEEL SHEET FOR DEEP DRAWING HAVING EXCELLENT FABRICATION EMBRITTLEMENT RESISTANCE AND PAINT-BAKE HARDENABILITY AND PROCESS FOR PRODUCING THE SAME

TECHNICAL FIELD

The present invention relates to non-aging at room temperature ferritic single-phase cold-rolled steel sheet and hot-dip galvanized steel sheet for deep drawing and a process for producing the same.

The cold-rolled steel sheets and the hot-dip galvanized steel sheets according to the present invention are subjected to press molding before being used in automobiles, domestic electric appliances, buildings, etc. Since the steel sheets according to the present invention have a combination of strength with formability, the use thereof enables the sheet thickness to be reduced to a greater extent than that of the conventional steel sheets. In other words, a reduction in weight is possible. Therefore, the steel sheets of the present invention can be expected to contribute to environmental protection.

BACKGROUND ART

The production of an extra low carbon steel by a melt process has now become easy by virtue of advances in vacuum degassing processes for molten steels in recent years. This has led to an ever-increasing demand for extra low carbon steel sheets having a good fabricability.

It is well known that the extra low carbon steel sheet of this type generally contains at least one of Ti and Nb. Specifically, Ti and Nb interact with interstitial solid solution elements (C, N) in the steel, by a strong force of attraction, to easily form carbonitrides. Therefore, the resultant steel is a steel free from interstitial solid solution elements (IF steel: interstitial free steel). Since the IF steel does not contain an interstitial solid solution element causative of a deterioration in strain aging and formability, it has a feature that the formability in a non-aging state is very good. Further, addition of Ti and Nb plays an important role in improving deep drawability of the cold-rolled annealed steel sheet by virtue of grain refining of a hot-rolled sheet of an extra low carbon steel which is likely to coarsen. However, the extra low carbon steel containing Ti and Nb has the following problems. First, the production cost is high. Specifically, in addition to a vacuum treatment cost for rendering the carbon content extra low, addition of expensive Ti and Nb is necessary. Second, since neither C nor N in a solid solution form remains in the product sheet, fabrication embrittlement occurs or the paint-bake hardening disappears. Thirdly, Ti and Nb are powerful oxide forming elements, and the formed oxides deteriorate the surface quality.

Much research and development has hitherto been made with a view to solving the above problems of IF steel. For example, Japanese Unexamined Patent Publication (Kokai) Nos. 60-197846 and 63-72830 disclose extra low carbon steel sheets containing neither Ti nor Nb and process for producing the same, and fundamentally, the above problems are solved by the following technique. In continuously annealing a steel having a C content in the range of from 0.0010 to 0.0080%, high-temperature annealing is used to transform part of $\alpha$ to $\gamma$, and a low-temperature transformation product from $\gamma$ is then formed by regulating the cooling rate to provide a mixed structure comprising $\alpha$ and $\gamma$. Since, however, the $(\alpha+\gamma)$ two-phase region of the extra low carbon steel is very narrow, it is difficult to regulate the temperature with a high accuracy. In addition, there occur various problems associated with annealing at a high temperature, for example, a poor travelability of the sheet at a high temperature, a poor sheet configuration and a high energy consumption. For this reason, the steel sheet of the present invention comprises a structure with a single $\alpha$ phase. Further, Japanese Unexamined Patent Publication (Kokai) Nos. 59-80727, 60-103129 and 1-184251 and the like disclose cold-rolled steel sheets containing none of expensive elements such as Ti and Nb and having a C content including a region of not more than 0.0015% and a process for producing the same. In these steel sheets, however, the addition of B, which is one of the features of the present invention, is not conducted. When the total C content is not more than 0.0015%, the amount of C present in grain boundaries is extremely small even though neither Ti nor Nb is added, which gives rise to fabrication embrittlement. Further, in Japanese Unexamined Patent application (Kokai) No. 58-141335, the C content range includes a region of 0.0015% or less, and B is added in an amount in the range of from 0.0005 to 0.0020%. However, When the C content is in a region of 0.0015% or less, the crystal grain diameter of the hot-rolled steel sheet is generally so large that the r value (average Lankford value) of the cold-rolled annealed sheet cannot be ensured. For this reason, it becomes necessary to take some measures for elements added and a hot-rolling method.

On the other hand, in the production of a hot-dip galvanized steel sheet using continuous hot-dip galvanizing equipment by the sendzimir method, if the steel contains elements, which easily form oxides, for stabilization, such as Ti and Nb, an oxide film is likely to remain on the surface of the steel sheet even when the steel sheet is subjected to reduction before plating. This oxide film has an effect both on the wettability of the steel sheet by plating and on the alloying reaction of Fe with Zn, which makes it difficult to stably produce steel sheets having a high quality.

DISCLOSURE OF THE INVENTION

An object of the present invention is to provide a cold-rolled steel sheet or a hot-dip galvanized steel sheet using an extra low carbon steel not containing expensive additive elements, such as Ti and Nb, which steel sheet is non-aging at room temperature and is excellent in fabrication embrittlement resistance, paint-bake hardenability and deep drawability as well as in platability in hot-dip galvanizing.

The present inventors have made extensive and intensive studies on means for providing a property of non-aging at room temperature without using expensive carbonitride forming elements, such as Ti and Nb, and, as a result, have found that use of an extra low carbon Al killed steel comprising an $\alpha$ single-phase structure having a total carbon content regulated to a certain value or less is very useful for this purpose.

Specifically, in the steel of the present invention, since the addition of Al enables N to be fixed as AlN in a product sheet, it is necessary to specify the C content causative of strain aging. The present inventors have found that a reduction in total C content to 15 ppm or less enables the steel sheet to be stably rendered a non-aging at room temperature even When the reduction ratio of temper rolling is 0.5%, that is, lower than that of the prior art.

The above novel finding was obtained by the following experiment.

Steels having compositions specified in Table 1 were prepared by vacuum melting on a laboratory scale. Specifically, in a group of steels A (A-1 to A-5) and a group of steels B (B-1 to B-5), the C content was varied on five levels in the range of from 0.0003% to 0.0030%. In these groups, the P content was 0.015% for steels A and 0,050% for steels B. On the other hand, in a group of steels C (C-1 to C-6) and a group of steels D (D-1 to D-6), the P content was varied in six levels in the range of from 0.0002% to 0.04%. In these groups, the C content was 0.0005% for steels C and 0.0012% for steels D.

Ingots having the above-described chemical compositions were hot-rolled under conditions of a slab heating temperature of 1150° C., a finishing temperature of 910° C. and a coiling temperature of 710° C. to provide steel sheets having a thickness of 4.0 mm. After pickling, the steel strips were cold-rolled with a reduction ratio of 80% to form cold-rolled sheets having a thickness of 0.8 mm and then subjected to continuous annealing under conditions of a heating rate of 15° C./sec, a soaking of 780° C. for 50 sec and a cooling rate of 20° C./sec. Further, the annealed sheet was subjected to temper rolling with a reduction ratio of 0.8% and subjected to a tensile test.

The tensile test was carried out according to a method specified in JIS2241. The paint-bake hardenability (BH property) is the level of an increment of the yield point when the tensile test is again effected after a material, which has been prestrained 2% by tension, is subjected to a heat treatment corresponding to baking at 170° C. for 20 min.

Experimental results are shown in FIG. 1. As is apparent from FIG. 1, even when none of Ti, Nb, etc. are added, the elongation at yield point after heat treatment at 100° C. for one hr (YP-El) is 0.2% or less so far as the total C content is 0.0015% or less, so that a property of a non-aging at room temperature can be attained.

In extra low carbon steels containing Ti and/or Nb, it becomes difficult to impart a good BH property if the total C content is 0.0001% or more. By contrast, in the steel of the present invention, as shown in FIG. 1, a good BH property can be imparted in a total C content in the range of from 0.0001 to 0.0015%.

TABLE 1

| Steel | Chemical composition (wt. %) | | | | | | | |
|---|---|---|---|---|---|---|---|---|
| No. | C | Si | Mn | P | S | Al | N | B |
| A1–A5 | 0.0003 to 0.0030 | 0.01 | 0.15 | 0.015 | 0.008 | 0.045 | 0.0012 | 0.0002 |
| B1–B5 | 0.0003 to 0.0030 | 0.01 | 0.15 | 0.050 | 0.008 | 0.045 | 0.0012 | 0.0002 |
| C1–C6 | 0.0005 | 0.01 | 0.15 | 0.0002 to 0.04 | 0.008 | 0.045 | 0.0012 | 0.0002 |
| D1–D6 | 0.0012 | 0.01 | 0.15 | 0.0002 to 0.04 | 0.008 | 0.045 | 0.0012 | 0.0002 |

Then, the present inventors have made studies on fabrication embrittlement resistance.

As a result, it has been found that the problem of the fabrication embrittlement becomes likely to occur when the total C content is brought to the above-described value, i.e., 15 ppm or less. This is considered attributable to a remarkable reduction in the content of C serving to strengthen grain boundaries.

Further, it has been found that addition of P for the purpose of improving the deep drawability or increasing the strength causes the above problem to become more pronounced.

In the steel of the present invention, addition of B has been found to be very useful for solving the above problem.

Third, the present inventors have made studies on deep drawability of extra low carbon steel sheets containing none of Ti, Nb and other additive elements.

In general, in steels containing neither Ti nor Nb, the crystal grain diameter of the hot-rolled steel sheets becomes large with a fall in the total C content. In particular, it becomes remarkably large when the total C content is not more than 15 ppm, and in some cases, the crystal becomes a very coarse columnar one extending in the thicknesswise direction of the sheet. However, in grains having a {111} orientation in a sheet plane, which are favorable for deep drawability, nucleation occurs preferentially from initial grain boundaries, so that the r value falls even when the carbon content is rendered extra low. For this reason, studies have been made on a method which enables the crystal grain diameter of the hot-rolled steel sheet to be reduced without adding expensive elements such as Ti and Nb. As a result, it has been found that 1) addition of P is effective with addition in an amount of not less than 0.01% being preferred, 2) this effect becomes more significant when P exists together with B and 3) still preferably, cooling within 1.0 sec after the completion of hot rolling at a rate of not less than 50° C./sec contributes to further grain refining. Although the reason for the above 1) has not been elucidated yet, it is believed to reside in the fact that addition of P gives rise to a) refinement of $\gamma$ grains and b) inhibition of grain growth of transformed $\alpha$. Addition of B is thought to reduce the $\alpha$ grain diameter after transformation since it reduces the transformation rate. Rapid cooling after hot roll finishing is considered useful for grain refining by virtue of inhibition of grain growth, an increase in $\gamma/\alpha$ ratio and other favorable phenomena.

An experiment was carried out on a change in r value by addition of P under the same conditions as those in the experiment shown in FIG. 1.

The results are shown in FIG. 2. As is apparent from the drawing, the addition of P in an amount of not less than 0.01% contributes to a marked improvement in a low r value, which is a drawback of the extra low carbon steels containing neither Ti nor Nb, particularly the $r_{45}$ value (r value in a direction at 45° to the rolling direction) to such a level as will suffice for use of the steel sheet for deep drawing.

Mn is useful as a solid solution strengthening element for increasing the strength without a significant increase in yield strength. However, it is said that a reduction in Mn content is preferred for improving the r value.

As a result of studies, however, the present inventors have obtained novel finding that coexistence of Mn and P gives rise to grain refining of a hot-rolled steel sheet comprising an extra low carbon steel. The reason why this phenomenon occurs is believed to reside in the fact that both the elements serve to thermodynamically countervail the $Ar_3$ temperature and kinetically delay the transformation of $\gamma$ to $\alpha$. Therefore, the present inventors have also obtained a useful finding that although a marked increase in Mn content generally leads to a significant deterioration in r value, addition of Mn in an amount up to 3.0% causes no significant deterioration in r value in extra low carbon steels having a P content of not less than 0.01% according to the present invention.

Specifically, as can be seen from the experimental example shown in FIG. 2, even when the amount of Mn added is as large as 0.15%, a high r value can be provided by adding 0.01% of P.

The present inventors have further made studies on the relationship between Mn and P. As a result, they have found that addition of not less than 0.2% of Mn and not less than 0.01% of P with Mn+20P≧0.3 can lead to significant grain refining of the structure of the hot-rolled steel sheet, so that the strength can be enhanced while maintaining a high r value.

The above finding was obtained through the following experiment.

Steels comprising Fe-0.0010% of C-0.01% of Si-0.003% of S-0.04% of Al-0.0012% of N and, added thereto, 0.5% or 1% of Mn and 0 to 0.05% of P were prepared by the melt process on a laboratory scale. The resultant steel slabs were heated to 1100° C., subjected to hot rolling at a finishing temperature in the range of from 880° to 930° C. (a temperature just above the $Ar_3$ transformation point), cooled within 0.5 sec after the completion of hot rolling at a cooling rate of 70° C./sec and coiled at 700° C.

Thereafter, the cooled steel sheets were cold-rolled with a reduction ratio of 85° C. to form cold-rolled steel sheets having a thickness of 0.7 mm and then subjected to annealing under conditions of a heating rate of 10° C./sec, soaking at 770° C. for 40 sec and a cooling rate of 60° C./sec. The experimental results for samples thus produced are shown in FIG. 3. As is apparent from the drawing, when the P content was 0 (zero), the r value was as low as 1.1 to 1.2 because the amount of Mn added was large. However, addition of 0.01% of P gave a rapid increase in r value to 1.6 to 1.7.

That is, addition of not less than 0.2% of Mn and not less than 0.01% of P with Mn+20P≧0.3 renders the effect of refining grains of the hot-rolled steel sheet significant while maintaining the high r value, which contributes to a marked improvement in strength.

B is an element that is very important for attaining the object of the present invention because it serves to improve the fabrication embrittlement resistance and, at the same time, to refine the structure of the hot-rolled steel sheet, in the steel of the present invention.

Specifically, B is considered to inhibit the transformation and consequently reduce the diameter of α grains after transformation, and the effect of refining grains becomes more significant when B and P coexist.

As Si, Mn and P, Cr is also an element useful for increasing the strength.

Therefore, in the present invention, addition of Cr in a predetermined amount, particularly in an amount range satisfying Cr+20P≧0.2%, is very useful for increasing the strength by grain refining of the structure of the hot-rolled steel sheet comprising an extra low carbon steel having a C content of not more than 0.0015% as contemplated in the present invention.

Hot-dip galvanized steel sheets are also contemplated in the present invention. Since the steel of the present invention contains no Ti or Nb, which fundamentally deteriorate the platability, it has an excellent platability.

In the production of the steel sheet of the present invention, the hot rolling is completed at a finishing temperature of not less than ($Ar_3$—100)° C. for the purpose of ensuring the formability (r value) of the product sheet, and in order to attain grain refining of the structure of the hot-rolled sheet, cooling is carried out within one sec after the completion of hot rolling, particularly within 0.5 sec after the completion of hot rolling at a rate of not less than 50° C./sec when Mn is added in an amount of not less than 0.2% with Mn+20P≧0.3 or Cr is added in an amount of not less than 0.1% with Cr+20P≧0.2.

BEST MODE FOR CARRYING OUT THE INVENTION

Figure 1A:
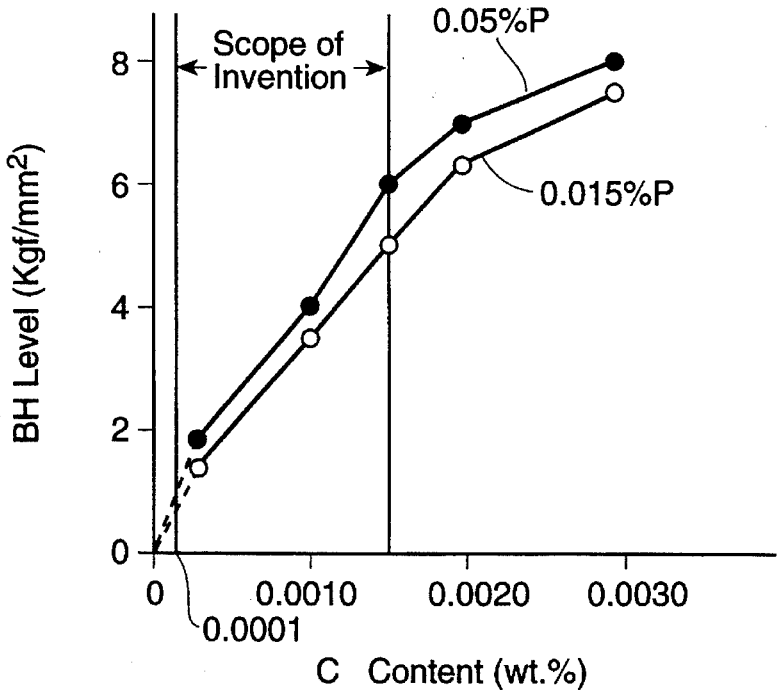
FIG. 1 is a diagram showing the relationship between the BH level and YP-El (after heat treatment at 100° C. for 1 hr) and the C content.
Figure 1B:
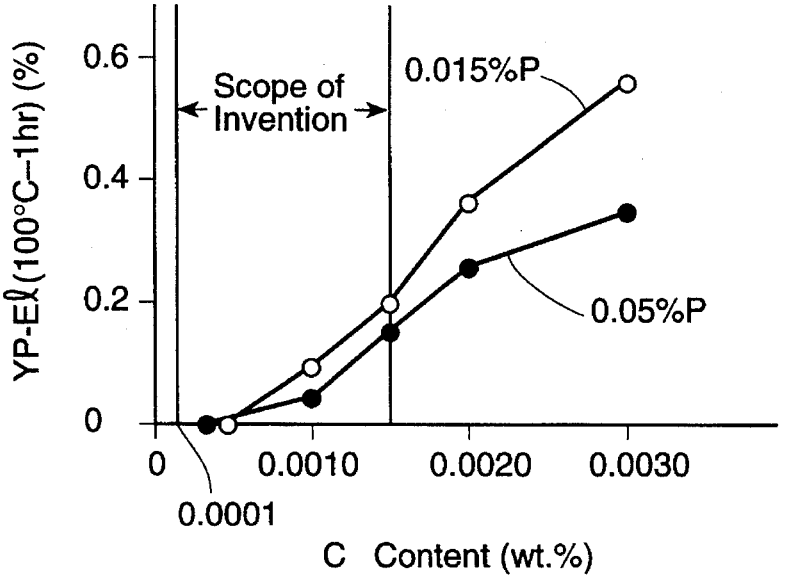
Figure 2A:
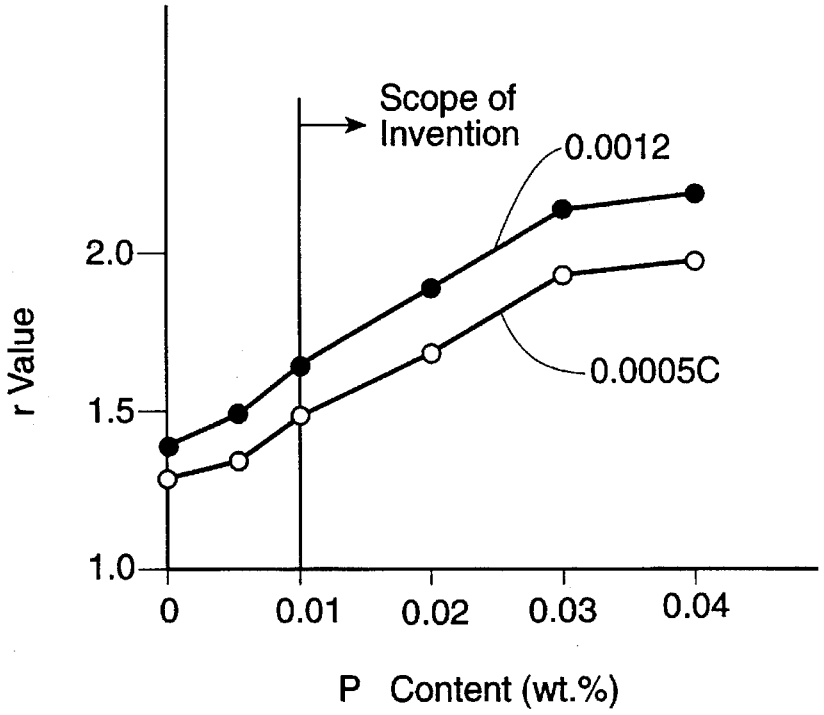
FIG. 2 is a diagram showing the relationship between the r value and $r_{45}$ value and the P content when the Mn content is 0.15%.
Figure 2B:
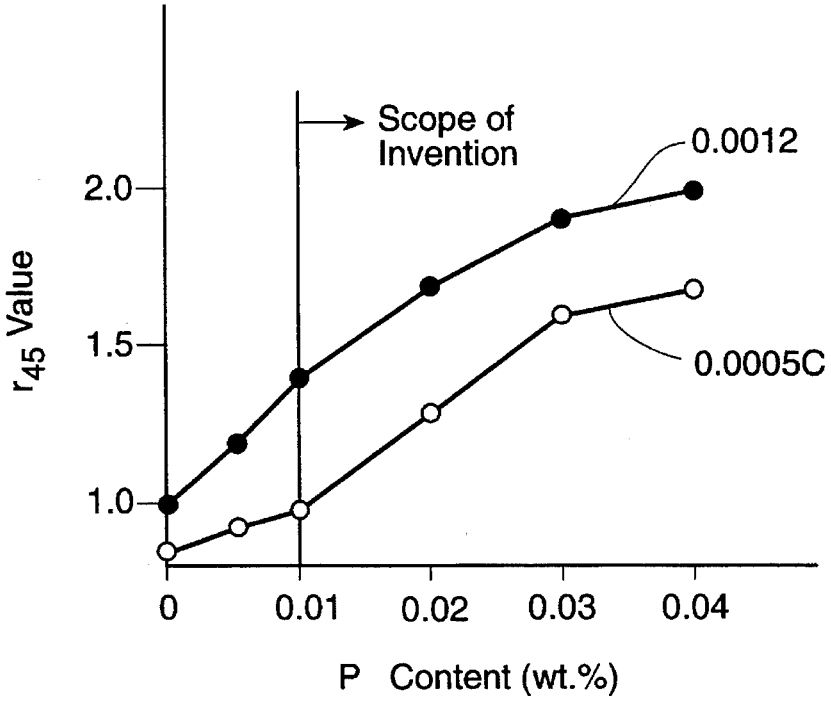
Figure 3:
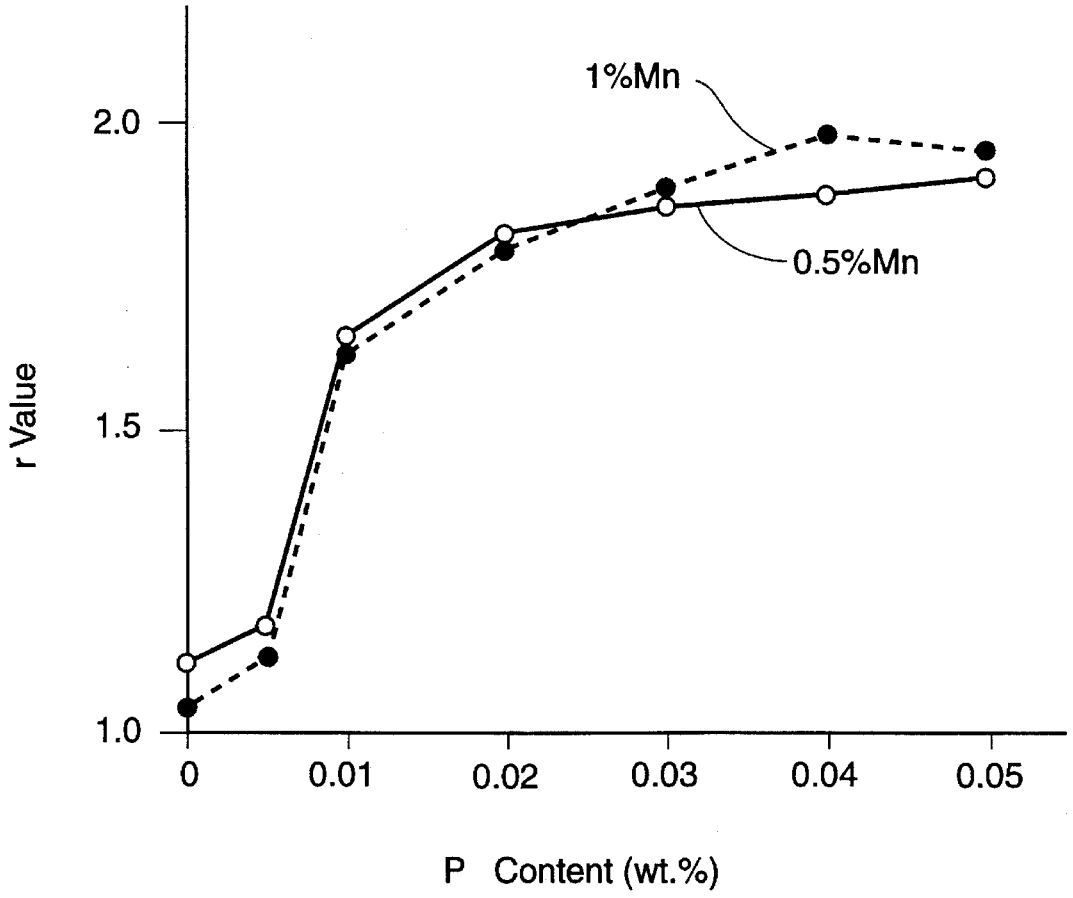
FIG. 3 is a diagram showing the relationship between the r value and the P content when the Mn contents are 0.5% and 1%.

At the outset, chemical ingredients of the steel sheet according to the present invention will be described.

C: C is a very important element that determines the quality of steel products. When the C content exceeds 0.0015%, the steel sheet loses a property of non-aging at room temperature. For this reason, the upper limit of the C content is 0.0015%. On the other hand, when the C content is less than 0.0001%, there occurs fabrication embrittlement. Further, this C content range is very difficult to attain from the viewpoint of current steelmaking techniques, which incurs a marked increase in cost. For this reason, the lower limit of the C content is 0.0001%.

When the steel sheet of the present invention is subjected to hot-dip galvanizing and greater importance is given to press moldability than to a property of non-aging at room temperature, the upper limit of C content is 0.0018% from the viewpoint of inhibiting the intrusion of hot-dip galvanizing into grain boundaries.

Si: Si is an element that can increase the strength at a low cost. However, when the Si content exceeds 1.2%, there occur problems, such as a fall in conversion treatability and a fall in platability, so that the upper limit is 1.2%. When the steel sheet is subjected to hot-dip galvanizing, failure of plating occurs if the Si content exceeds 0.7%, so that, in this case, the upper limit is preferably 0.7%.

Mn: As with Si, Mn is an element useful for increasing the strength. Further, in the steel of the present invention not containing Ti or other elements, since Mn fixes S, Mn serves to prevent cracking during hot rolling. Although a reduction in Mn content has hitherto been said to be favorable for improving the r value, cracking occurs during hot rolling if the Mn content is less than 0.03%. For this reason, the lower limit of the Mn content is 0.03%. On the other hand, in extra low carbon steels containing not less than 0.01% of P, no significant lowering in r value occurs when the Mn content is up to 3.0%. For this reason, in the present invention, the upper limit of the Mn content is 3.0% on the premise that P is added in an amount in the range of from 0.01 to 0.15%.

P: As with Si and Mn, P is also known to be an element which can increase the strength, and the amount of P to be added varies depending upon the target strength level. In hot-rolled steel sheets of extra low carbon steels containing neither Ti nor Nb, an increase in grain diameter is generally observed. Addition of P in an amount of not less than 0.01%, however, gives rise to significant grain refining. For this reason, the lower limit of the P content is 0.01%. However, when the amount of P added exceeds 0.15%, there occur problems, such as deterioration in cold rollability and fabrication embrittlement, so that the upper limit of the P content is 0.15%. Further, as described above, the grain refining effect of P becomes more significant when P and Mn coexist.

In the steel of the present invention, when the Mn content is 0.2% or more, the grain refining of the hot-rolled steel sheet can be more effectively attained by adding Mn and P in respective amounts satisfying $Mn+20P \geqq 0.3\%$.

S: The lower the S content, the better the results. However, when the S content is less than 0.0010%, the production cost becomes so high that the lower limit is 0.0010%. On the other hand, when it exceeds 0.020%, a large amount of MnS is precipitated to deteriorate the formability, so that the upper limit is 0.020%.

Al: Al is used for deoxidation. When the Al content is less than 0.005%, stable deoxidation becomes difficult. On the other hand, it exceeds 0.1%, the cost is increased. For this reason, the lower limit and the upper limit are 0.005% and 0.1%, respectively.

N: The lower the N content, the better the results. Since, however, a lowering in N content to less than 0.0001% incurs a marked increase in cost, the lower limit of the N content is 0.0001%. On the other hand, when it exceeds 0.0080%, it becomes difficult to fix N by Al, so that N in a solid solution form causative of strain aging remains or the proportion of AlN is increased, which causes the formability to be deteriorated. For this reason, the upper limit of the N content is 0.0080%.

B: B segregates at grain boundaries, which is useful for preventing fabrication embrittlement and effective for reducing the grain diameter of the hot-rolled steel sheet. Addition of B in an amount in the range of from 0.0001 to 0.0030% suffices for attaining the above effects. When the B content is less than 0.0001%, the above effect is unsatisfactory. On the other hand, when it exceeds 0.0030%, an increase in cost accompanying the addition of B, and cracking of the slab, are likely to occur.

Cr: As with Mn, P and Si, Cr is an element useful for increasing the strength. When the amount of Cr added exceeds 3%, the r value lowers. Further, in this case, the conversion treatability and platability are deteriorated. For this reason, the upper limit of the Cr content is 3%. On the other hand, the amount of Cr added is less than 0.1%, the effect of increasing the strength is unsatisfactory.

When P is added in an amount of not less than 0.01% as contemplated in the steel of the present invention, it is necessary to add Cr and P in respective amounts satisfying $Cr+20P \geqq 0.2\%$.

It is generally preferred for Cr, P and B to be added respectively in the range of from 0.2 to 1.0%, in the range of from 0.01 to 0.1% and in the range of from 0.0002 to 0.0010%.

As with Mn, Cr, P, B and other elements are considered to inhibit recrystallization in a $\gamma$ region and lower the $\gamma \rightarrow \alpha$ transformation temperature to increase the nucleation frequency in transformation or inhibit the growth of transformed $\alpha$ grains, thereby attaining grain refining.

Conditions for the production of the steel of the present invention will now be described. At the outset, a slab comprising the above-described elements is heated to a temperature in the range of from 1,000° to 1,350° C. and hot-rolled. The finishing temperature (hot-rolling termination temperature) is $(Ar_3-100)$° C. or above from the viewpoint of ensuring the formability (r value) of the product sheet. Cooling is effected within one sec, preferably within 0.5 sec after the completion of the hot rolling at a cooling rate of not less than 50° C./sec to a coiling temperature.

The resultant steel strip is coiled at a temperature in the range of from 600° to 750° C. When the coiling temperature exceeds 750° C., the capability of being pickled is deteriorated or the quality in the longitudinal direction of the coil becomes heterogeneous. For this reason, the upper limit is 750° C. On the other hand, when the coiling temperature is below 600° C., the precipitation of AlN in the hot-rolled steel sheet becomes so unsatisfactory that the formability of the product sheet is deteriorated, so that the lower limit is 600° C.

Then, the above steel strip is cold-rolled. In this case, the reduction ratio is 60% or more from the viewpoint of ensuring the r value of the product sheet.

Subsequently, the cold-rolled steel strip is then subjected to continuous annealing at an annealing temperature in the range of from 600° to 900° C. When the annealing temperature is below 600° C., the recrystallization is so unsatisfactory that the formability of the product sheet becomes a problem. The formability improves with increasing the annealing temperature. However, when the annealing temperature exceeds 900° C., the excessively high temperature gives rise to breaking of the sheet or a deterioration in flatness.

When the cold-rolled steel strip is subjected to hot-dip galvanizing, the steel strip is transferred to, for example, continuous hot-dip galvanizing equipment of the sendzimir type where it is subjected to softening annealing, hot-dip galvanizing and optionally heat treatment for alloying. The annealing temperature is in the range of from 600° to 900° C. When the annealing temperature is below 600° C., the recrystallization is so unsatisfactory that the formability of the product sheet becomes a problem. The formability improves with increasing the annealing temperature. However, when the annealing temperature exceeds 900° C., the excessively high temperature gives rise to breaking of the sheet or a deterioration in flatness.

Thus, the present invention has been made based on the above-described novel idea and novel finding, and according to the present invention, it is possible to provide, without adding expensive elements such as Ti and Nb, a thin steel sheet or a hot-dip galvanized steel sheet that is a non-aging at room temperature and has good fabrication embrittlement resistance, paint-bake hardenability and deep drawability and an excellent platability.

EXAMPLES

Example 1

Steels having chemical compositions specified in Table 2 were prepared by the melt process on a commercial scale, cast and then subjected to hot rolling (heating temperature: 1,200° C., finishing temperature: 930° C., coiling temperature: 710° C.), cold rolling (reduction ratio: 80%), continuous annealing (comprising holding at 780° C. for 40 sec and overaging at 400° C. for 2 min) and temper rolling (0.8%).

The tensile test was carried out according to a method specified in JIS2241. The paint-bake hardenability (BH property) is the level of an increment of the yield point when the tensile test is again effected after a material, which has been prestrained 2% by tension, is subjected to a heat treatment corresponding to baking at 170° C. for 20 min.

The fabricability was evaluated by subjecting the annealed steel sheet to punching to form a disk, drawing the disk into cups with a drawing ratio of 1.6, turning the cups having varied temperatures over a tool in a truncated cone form, dropping a 300 kg weight from a height of 1 m onto the cups to impact the cups and determining the ductility-embrittlement transition temperature if the cup was broken. In this case, when the ductility-embrittlement transition temperature was −20° C. or below, the fabricability was evaluated as good.

As is apparent from Table 3, according to the present invention, non-aging at room temperature cold-rolled steel sheets for deep drawing, which have a strength on a level in the range of from 30 to 45 kgf/mm$^2$, can be provided using steels containing no expensive elements such as Ti and Nb. These non-aging at room temperature cold-rolled steel sheets for deep drawing can also have a BH property. Further, it is apparent that addition of B in a very small amount contributes to a marked improvement in fabrication embrittlement resistance. In this connection, it is noted that steels 3-1 and 3-2, of which the strength had been increased by simultaneously adding P and Mn, had good r value and $r_{45}$ values despite the fact that the Mn content was high. This suggests that simultaneous addition of P and Mn are useful also for grain refining of hot-rolled steel sheets.

TABLE 2

| Steel | Chemical composition (wt. %) | | | | | | | |
|---|---|---|---|---|---|---|---|---|
| No. | C | Si | Mn | P | S | Al | N | B |
| 1-1 | 0.0004 | 0.03 | 0.15 | 0.03 | 0.008 | 0.060 | 0.0025 | 0.0003 |
| 1-2 | 0.0004 | 0.03 | 0.15 | 0.03 | 0.008 | 0.060 | 0.0025 | — |
| 2-1 | 0.0012 | 0.02 | 0.12 | 0.08 | 0.007 | 0.040 | 0.0018 | 0.0007 |
| 2-2 | 0.0012 | 0.02 | 0.12 | 0.08 | 0.007 | 0.040 | 0.0018 | — |
| 3-1 | 0.0009 | 0.10 | 0.7 | 0.06 | 0.010 | 0.054 | 0.0011 | 0.0005 |
| 3-2 | 0.0009 | 0.10 | 1.8 | 0.06 | 0.010 | 0.054 | 0.0011 | 0.0004 |

TABLE 3

| Steel No. | YP (kgf/mm$^2$) | TS | T-El (%) | r value | $r_{45}$ value | YP-El (%) | BH (kgf/mm$^2$) | Transition temp. (°C.) | Remarks |
|---|---|---|---|---|---|---|---|---|---|
| 1-1 | 17 | 32 | 49 | 1.7 | 1.4 | 0 | 2.3 | −90 | Steel of invention |
| 1-2 | 16 | 31 | 50 | 1.8 | 1.4 | 0 | 1.6 | −18 | Comparative steel |
| 2-1 | 21 | 38 | 44 | 1.9 | 1.5 | 0.1 | 5.3 | −70 | Steel of invention |
| 2-2 | 20 | 37 | 46 | 1.9 | 1.6 | 0.1 | 3.8 | −10 | Comparative steel |
| 3-1 | 21 | 40 | 40 | 1.7 | 1.4 | 0 | 4.1 | −70 | Steel of invention |
| 3-2 | 24 | 43 | 38 | 1.5 | 1.4 | 0.1 | 4.8 | −60 | Steel of invention |

Example 2

Conditions for cooling after the completion of hot rolling were studied using steels 1-1 and 2-1 specified in Table 2 by means of commercial equipment. The relationship between hot rolling conditions, r value of product sheets and $r_{45}$ value is shown in Table 4. In this case, cooling conditions after finishing, particularly the time taken until the initiation of rapid cooling and cooling rate were studied with respect to the hot rolling conditions. Cold rolling was carried out with a reduction ratio of 80%, and the sheet thickness was 0.8 mm. The steel sheet was then subjected to continuous annealing at 780° C. for 40 sec and temper rolling with a reduction ratio of 0.8%. As is apparent from Table 4, the steel steels satisfy the r value and $r_{45}$ value requirements as a steel sheet for deep drawability even when they are produced under usual conditions. However, it is preferred to effect rapid cooling as early as possible after the completion of hot rolling because the r value, particularly $r_{45}$ value, can be remarkably improved. This phenomenon is thought attributable to grain refining of the hot-rolled steel sheet by rapid rolling immediately after hot rolling.

TABLE 4

| | Hot-rolling conditions | | | | | Property values for product sheet | | |
|---|---|---|---|---|---|---|---|---|
| Steel No. | SRT (°C.) | FT (°C.) | t (s) | CR (°C./s) | CT (°C.) | r value | $r_{45}$ value | Remarks |
| 1-1 | 1150 | 910 | 0.1 | 100 | 730 | 2.1 | 1.8 | Favor- |
| (900° C.) | 1150 | 910 | 0.5 | 20 | 730 | 1.7 | 1.4 | able |
| | 1150 | 910 | 0.5 | 100 | 730 | 1.9 | 1.6 | conditions |
| 2-1 | 1150 | 930 | 0.1 | 100 | 730 | 2.3 | 2.0 | Favor- |
| (920° C.) | 1150 | 930 | 0.5 | 20 | 730 | 1.9 | 1.5 | able |
| | 1150 | 930 | 0.5 | 100 | 730 | 2.1 | 1.9 | condition |

Note) SRT: slab heating temp.; FT: finishing temp.; t: cooling initiation time after finishing; CR: cooling rate; CT: coiling temp.; and numbers in parentheses: $Ar_3$ temperature.

Example 3

Steels having compositions specified in Table 5 were prepared by the vacuum melt process on a laboratory scale. In steel A, the C content was varied in the range of from 0.0004 to 0.0030%. On the other hand, in steel B, the Mn content was varied in the range of from 0.10 to 1.20%, and the P content was varied in the range from 0.005 to 0.06%. The resultant steel slab was hot-rolled under the following conditions. Specifically, the slab was heated at 1150° C., subjected to hot rolling at a finishing temperature of 910° C., cooled within 0.2 sec after the finishing at a cooling rate of 80° C./sec and coiled at 710° C. The sheet thickness was 4.0 mm. After pickling, cold rolling was effected with a reduction ratio of 80% to form cold-rolled steel sheets having a thickness of 0.8 mm, and the cold-rolled steel sheets were subjected to continuous annealing under conditions of a heating rate of 15° C./sec, soaking at 800° C. for 50 sec and a cooling rate of 20° C./sec. Further, the annealed steel sheets were subjected to temper rolling with a reduction ratio of 0.8% and applied to a tensile test. The tensile test was carried out according to a method specified in JIS2241. Further, the fabricability was determined by punching a blank having a diameter of 110 mm from a temper-rolled steel sheet, molding a cup using a punch having a diameter of 50 mm and recessing the cup by up to 20 mm with a conical punch having a vertical angle of 53° at various temperatures and determining the ductility-embrittlement transition temperature when the cup was broken. In this case, when the ductility-embrittlement transition temperature was −50° C. or below, the fabricability was evaluated as good.

Experimental results are given in Table 6.

As is apparent from Table 6, even when none of Ti, Nb and other additive elements were added, if the total C content was 0.0015% or less, the elongation at yield point after heat treatment at 100° C. for one hr (YP-El) became 0.2% or less, so that a non-aging property at room temperature as the object of the present invention could be attained. Further, the r value, particularly $r_{45}$ value, was remarkably improved by using an extra low carbon steel having a C content of about 0.0007% and satisfying the requirements of Mn≧0.2%, P≧0.0010% and Mn+20P≧0.3 and subjecting the steel sheet to controlled cooling after hot rolling to such a level as will make it suffice as a steel sheet for deep drawing. Therefore, according to the present invention, a cold-rolled steel sheet having a property of non-aging at room temperature and an excellent deep drawability can be provided without adding expensive elements such as Ti and Nb. Further, the steel of the present invention has a good fabrication resistance.

Example 4

Based on finding described in Example 3, steels having chemical compositions specified in Table 7 were prepared by the melt process on a commercial scale, cast and then subjected to hot rolling (heating temperature: 120° C., finishing temperature: 930° C., cooling after finishing: cooling 0.3 sec after hot rolling finishing to 740° C. at 100° C./sec, coiling temperature: 680° C.), cold rolling (reduction ratio: 80%), continuous hot-dip galvanizing (maxim heating temperature: 820° C., hot-dip galvanizing: 460° C. (Al concentration of bath: 0.11%), alloying treatment: 520° C.×20 sec) and temper rolling (0.8%). A tensile test was effected in the same manner as that of Example 1. Further, evaluation of plating adhesion and measurement of the concentration of Fe in plating were carried out for evaluating the platability.

In the evaluation of the adhesion of plating, the plated sheet was bent at 180° C. for close overlapping, and an adhesive tape was adhered to the bent portion and then peeled off to measure the amount of peeled plating to evaluate the peeling of the galvanized coating. The evaluation was made based on the following five grades.

1: large peeling, 2: medium peeling, 3: small peeling, 4: very small peeling, and 5: no peeling.

The concentration of Fe in the plating was determined by X-ray diffractometry.

The fabricability was evaluated in the same manner as that of Example 3.

As is apparent from Table 8, the steel of the present invention can provide a non-aging at room temperature alloyed hot-dip galvanized steel sheet for deep drawing having an excellent platability in hot-dip galvanizing and is good also in fabrication embrittlement resistance.

TABLE 5

| Steel | Chemical composition (wt. %) | | | | | | | | | |
|---|---|---|---|---|---|---|---|---|---|---|
| No. | C | Si | Mn | P | S | Al | N | B | Mn + 20P | Remarks |
| A1 | 0.0004 | 0.01 | 0.20 | 0.035 | 0.008 | 0.045 | 0.0012 | 0.0002 | 0.9 | Steel of |
| A2 | 0.0008 | 0.01 | 0.20 | 0.035 | 0.008 | 0.045 | 0.0012 | 0.0005 | 0.9 | invention |
| A3 | 0.0017 | 0.01 | 0.20 | 0.035 | 0.008 | 0.045 | 0.0012 | 0.0002 | 0.9 | |
| A4 | 0.0030 | 0.01 | 0.20 | 0.035 | 0.008 | 0.045 | 0.0012 | 0.0005 | 0.9 | Comparative |
| B1 | 0.0006 | 0.01 | 0.10 | 0.005 | 0.008 | 0.045 | 0.0012 | 0.0002 | 0.2 | steel |
| B2 | 0.0007 | 0.01 | 0.25 | 0.015 | 0.008 | 0.045 | 0.0012 | 0.0002 | 0.55 | Steel of |
| B3 | 0.0006 | 0.04 | 0.65 | 0.010 | 0.008 | 0.045 | 0.0012 | 0.0002 | 0.85 | invention |
| B4 | 0.0007 | 0.01 | 0.25 | 0.060 | 0.008 | 0.045 | 0.0012 | 0.0005 | 1.45 | |
| B5 | 0.0008 | 0.06 | 1.20 | 0.040 | 0.008 | 0.045 | 0.0012 | 0.0004 | 2.00 | |

TABLE 6

| Steel No. | YP (kgf/mm²) | TS | T-El (%) | r value | $r_{45}$ value | YP-El (%) | Transition temp. (°C.) | Remarks |
|---|---|---|---|---|---|---|---|---|
| A1 | 17 | 32 | 47 | 1.8 | 1.5 | 0 | −75 | Steel of |
| A2 | 18 | 33 | 46 | 1.8 | 1.5 | 0 | −80 | invention |
| A3 | 18 | 34 | 45 | 1.9 | 1.6 | 0 | −95 | |
| A4 | 20 | 35 | 44 | 2.1 | 1.8 | 0.7 | −120 | Comparative |
| B1 | 13 | 27 | 58 | 1.4 | 1.1 | 0 | −95 | steel |
| B2 | 14 | 29 | 51 | 1.7 | 1.4 | 0 | −90 | Steel of |
| B3 | 16 | 31 | 50 | 1.9 | 1.6 | 0 | −85 | invention |
| B4 | 19 | 36 | 45 | 2.1 | 1.8 | 0 | −95 | |
| B5 | 22 | 38 | 43 | 2.0 | 1.7 | 0 | −90 | |

TABLE 7

| Steel No. | Chemical composition (wt. %) C | Si | Mn | P | S | Al | N | B | Mn + 20P | Remarks |
|---|---|---|---|---|---|---|---|---|---|---|
| 1 | 0.0007 | 0.02 | 0.10 | 0.005 | 0.008 | 0.050 | 0.0013 | 0.0002 | 0.2 | Comparative steel |
| 2 | 0.0004 | 0.03 | 0.65 | 0.01 | 0.008 | 0.080 | 0.0025 | 0.0003 | 0.85 | Steel of |
| 3 | 0.0009 | 0.02 | 0.80 | 0.06 | 0.007 | 0.100 | 0.0018 | 0.0007 | 2.0 | invention |
| 4 | 0.0020 | 0.02 | 0.80 | 0.08 | 0.007 | 0.040 | 0.0018 | — | 2.4 | Comparative steel |

TABLE 8

| Steel No. | YP (kgf/mm$^2$) | TS (kgf/mm$^2$) | T-El (%) | r value | $r_{45}$ value | YP-El (%) | Transition temp. (°C.) | Adhesion of plating | Concentration of Fe in plating (%) | Remarks |
|---|---|---|---|---|---|---|---|---|---|---|
| 1 | 13 | 27 | 57 | 1.6 | 1.2 | 0 | −110 | 5 | 12 | Comparative steel |
| 2 | 18 | 32 | 48 | 1.8 | 1.5 | 0 | −100 | 5 | 10 | Steel of |
| 3 | 22 | 38 | 43 | 1.8 | 1.5 | 0 | −80 | 5 | 8 | invention |
| 4 | 23 | 39 | 42 | 1.8 | 1.6 | 0.1 | −10 | 5 | 6 | Comparative steel |

Example 5

The procedure of Example 4 was repeated, except that no alloying treatment was carried out in the continuous hot-dip galvanizing. The sample used was steel 3 of Example 4, and the continuous hot-dip galvanizing was carried out under conditions of a maximum heating temperature of 780° C. and a hot-dip galvanizing temperature of 460° C. After the temper rolling (0.8%), the evaluation was carried out in the same manner as that of Example 2. The property values were as given in Table 5. According to the present invention, it is possible to produce a non-aging at room temperature hot-dip galvanized steel sheet for deep drawing.

TABLE 9

| YP (kgf/mm$^2$) | TS (kgf/mm$^2$) | T-El (%) | r value | $r_{45}$ value | YP-El (%) | Transition temp. (°C.) | Remarks |
|---|---|---|---|---|---|---|---|
| 21 | 37 | 44 | 2.0 | 1.7 | 0 | −90 | Steel of invention |

Example 6

Conditions for cooling after the completion of hot rolling were studied using steels 2 and 3 specified in Table 7 by means of commercial equipment. The relationship between hot rolling conditions and r value and $r_{45}$ value of product sheets is shown in Table 10. In this case, cooling conditions after finishing, particularly the time taken until the initiation of rapid cooling and cooling rate were studied with respect to the hot rolling conditions. Cold rolling was carried out with a reduction ratio of 80%, and the sheet thickness was 0.8 mm. The steel sheet was then subjected to continuous annealing at 780° C. for 40 sec and temper rolling with a reduction ratio of 0.8. As is apparent from Table 10, in the steel ingredients specified in the present invention, cooling within 0.5 sec after the completion of hot rolling to 750° C. or below at a cooling rate of not less than 50° C./sec is important to an improvement in r value, particularly $r_{45}$ value, independently of the hot finish rolling temperature.

TABLE 10

| Steel No. | Hot-rolling conditions SRT (°C.) | FT (°C.) | t (s) | CR (°C./s) | CT (°C.) | Property values for product sheet r value | $r_{45}$ value | Remarks |
|---|---|---|---|---|---|---|---|---|
| 2 | 1150 | 910 | 0.1 | 100 | 730 | 1.8 | 1.5 | Steel of invention |
| | 1150 | 910 | 0.3 | 20 | 730 | 1.5 | 1.2 | Comparative steel |
| | 1150 | 910 | 0.7 | 100 | 730 | 1.4 | 1.1 | Comparative steel |
| 3 | 1150 | 960 | 0.2 | 100 | 730 | 1.8 | 1.5 | Steel of invention |
| | 1150 | 960 | 0.4 | 20 | 730 | 1.5 | 1.1 | Comparative steel |
| | 1150 | 960 | 0.7 | 100 | 730 | 1.5 | 1.2 | Comparative steel |

Note) SRT: slab heating temp.; FT: finishing temp.; t: cooling initiation time after finishing; CR: cooling rate; and CT: coiling temp.

Example 7

Steels having compositions specified in Table 11 were prepared by the vacuum melt process on a laboratory scale. In steel A, the C content was varied in the range of from 0.0004 to 0.0030%. On the other hand, in steel B, the Cr content was varied in the range of from 0.01 to 1.50%, and the P content was varied in the range of from 0.005 to 0.120%. The resultant steel slab was hot-rolled under the following conditions. Specifically, the slab was heated to 1,150° C., subjected to finish rolling at a finishing temperature of 910° C., cooled within 0.2 sec after the finishing at a cooling rate of 80° C./sec and coiled at 710° C. The sheet thickness was 4.0 min. After pickling, cold rolling was effected with a reduction ratio of 80% to form cold-rolled steel sheets having a thickness of 0.8 mm, and the cold-rolled steel sheets were subjected to continuous annealing under conditions of a heating rate of 15° C./sec, soaking at 800° C. for 50 sec and a cooling rate of 20° C./sec. Further, the annealed steel sheets were subjected to a temper rolling with a reduction ratio of 0.8% and then subjected to a tensile test. The tensile test was carried out according to a method specified in JIS2241. The strain aging property was evaluated in terms of elongation at yield point (YP-El) after artificial aging at 100° C. for one hr. When the elongation at yield point was 0.2% or less, the steel sheet was regarded as non-aging. The paint-bake hardenability (BH property) is the level of an increment of the yield point when the tensile test is again effected after a material, which has been prestrained 2% by tension, is subjected to a heat treatment corresponding to painting baking at 170° C. for 20 min. The fabricability was determined by punching a blank having a diameter of 110 mm from a temper-rolled steel sheet, molding a cup using a punch having a diameter of 50 mm and recessing the cup by up to 20 mm with a conical punch having a vertical angle of 53° at various temperatures and determining the ductility-embrittlement transition temperature when the cup was broken. In this case, when the ductility-embrittlement transition temperature was −50° C. or below, the fabricability was evaluated as good.

As is apparent from Table 12, even when none of Ti, Nb and other additive elements were added, if the total C content was 0.0015% or less, the elongation at yield point after heat treatment at 100° C. for one hr (YP-El) became 0.2% or less, so that a property of a non-aging at room temperature as the object of the present invention could be attained. Further, as is apparent from the same table, the r value, particularly $r_{45}$ value, was remarkably improved by using an extra low carbon steel having a C content in the range of from 0.0006 to 0.0013% and satisfying requirements of Cr≧0.1%, P≧0.01% and Cr+20P≧0.2% and subjecting the steel sheet to controlled cooling after hot rolling to such a level as will suffice for use as a steel sheet for deep drawing. Therefore, according to the present invention, a cold-rolled steel sheet having a non-aging property at room temperature and an excellent deep drawability can be provided without adding expensive elements such as Ti and Nb. Further, as is apparent from Table 12, the steels of the present invention had paint-bake hardenability and good fabrication embrittlement resistance.

TABLE 11

| Steel | Chemical composition (wt. %) | | | | | | | | | | |
|---|---|---|---|---|---|---|---|---|---|---|---|
| No. | C | Si | Mn | P | Cr | S | Al | N | B | Cr + 20P | Remarks |
| A1 | 0.0004 | 0.01 | 0.20 | 0.035 | 0.50 | 0.008 | 0.045 | 0.0012 | 0.0002 | 1.2 | Steel of invention |
| A2 | 0.0008 | 0.01 | 0.20 | 0.035 | 0.50 | 0.008 | 0.045 | 0.0012 | 0.0005 | 1.2 | Steel of invention |
| A3 | 0.0014 | 0.01 | 0.20 | 0.035 | 0.50 | 0.008 | 0.045 | 0.0012 | 0.0002 | 1.2 | Steel of invention |
| A4 | 0.0030 | 0.01 | 0.20 | 0.035 | 0.50 | 0.008 | 0.045 | 0.0012 | 0.0005 | 1.2 | Comparative steel |
| B1 | 0.0006 | 0.01 | 0.10 | 0.005 | — | 0.012 | 0.045 | 0.0012 | 0.0002 | 0.10 | Comparative steel |
| B2 | 0.0013 | 0.01 | 0.15 | 0.015 | 0.15 | 0.010 | 0.045 | 0.0012 | 0.0002 | 0.45 | Steel of invention |
| B3 | 0.0006 | 0.04 | 0.65 | 0.035 | 0.45 | 0.008 | 0.045 | 0.0012 | 0.0002 | 1.15 | Steel of invention |
| B4 | 0.0011 | 0.01 | 0.25 | 0.060 | 1.05 | 0.008 | 0.045 | 0.0012 | 0.0005 | 2.25 | Steel of invention |
| B5 | 0.0008 | 0.06 | 1.50 | 0.120 | 1.50 | 0.008 | 0.045 | 0.0012 | 0.0004 | 4.55 | Steel of invention |

TABLE 12

| Steel No. | YP (kgf/mm²) | TS | T-El (%) | r value | $r_{45}$ value | YP-El (%) | BH (kgf/mm²) | Transition temp. (°C.) | Remarks |
|---|---|---|---|---|---|---|---|---|---|
| A1 | 17 | 32 | 48 | 1.8 | 1.5 | 0 | 0.5 | −75 | Steel of invention |
| A2 | 18 | 32 | 47 | 1.8 | 1.5 | 0 | 2.7 | −80 | Steel of invention |
| A3 | 18 | 33 | 46 | 1.9 | 1.6 | 0.1 | 4.5 | −95 | Steel of invention |
| A4 | 29 | 34 | 45 | 2.1 | 1.8 | 0.7 | 8.3 | −120 | Comparative steel |
| B1 | 13 | 27 | 58 | 1.4 | 1.1 | 0 | 1.8 | −85 | Comparative steel |
| B2 | 14 | 30 | 51 | 1.7 | 1.4 | 0 | 3.8 | −90 | Steel of invention |
| B3 | 18 | 34 | 46 | 1.9 | 1.6 | 0 | 1.9 | −80 | Steel of invention |
| B4 | 20 | 37 | 43 | 2.1 | 1.8 | 0 | 3.0 | −75 | Steel of invention |
| B5 | 28 | 47 | 34 | 1.8 | 1.5 | 0 | 2.5 | −55 | Steel of invention |

Example 8

Based on finding described in Example 7, steels having chemical compositions specified in Table 13 were prepared by the melt process on a commercial scale, cast and then subjected to hot rolling (heating temperature: 1200° C., finishing temperature: 930° C., cooling after finishing: cooling 0.3 sec after hot rolling finishing to 740° C. at 100° C./sec, coiling temperature: 710° C.), cold rolling (reduction ratio: 84%), continuous hot-dip galvanizing (maximum heating temperature: 820° C., hot-dip galvanizing: 460° C. (Al concentration of bath: 0.11%), alloying treatment: 520° C.×20 sec) and temper rolling (0.8%). A tensile test was effected in the same manner as that of Example 7. Further, evaluation of plating adhesion and measurement of the concentration of Fe in plating were carried out for evaluating the platability. The platability was evaluated in the same manner as that of Example 4.

The concentration of Fe in the plating was determined by X-ray diffractometry.

The fabricability was evaluated in the same manner as that of Example 7.

As is apparent from Table 14, the steel of the present invention could provide a non-aging at room temperature alloyed hot-dip galvanized steel sheet for deep drawing and having a good platability in hot-dip galvanizing and is good also in paint-bake hardenability and fabrication embrittlement resistance.

Example 9

The procedure of Example 8 was repeated, except that no alloying treatment was carried out in the continuous hot-dip galvanizing. The sample used was steel 3 of Example 8, and the continuous hot-dip galvanizing was carried out under conditions of a maximum heating temperature of 780° C. and a hot-dip galvanizing temperature of 460° C. After the temperature rolling (0.8%), evaluation was carried out in the same manner as that of Example 2. The property values were as given in Table 15. According to the present invention, it is possible to produce a non-aging at room temperature hot-dip galvanized steel sheet for deep drawing.

TABLE 13

| Steel | Chemical composition (wt. %) | | | | | | | | | | |
|---|---|---|---|---|---|---|---|---|---|---|---|
| No. | C | Si | Mn | P | Cr | S | Al | N | B | Cr + 20P | Remarks |
| 1 | 0.0011 | 0.02 | 0.10 | 0.005 | — | 0.011 | 0.050 | 0.0013 | 0.0002 | 0.1 | Comparative steel |
| 2 | 0.0004 | 0.03 | 0.20 | 0.01 | 0.2 | 0.010 | 0.060 | 0.0025 | 0.0003 | 0.4 | Steel of invention |
| 3 | 0.0009 | 0.1 | 0.80 | 0.06 | 1.0 | 0.007 | 0.040 | 0.0018 | 0.0007 | 2.2 | Steel of invention |
| 4 | 0.0020 | 0.02 | 0.40 | 0.08 | 0.7 | 0.007 | 0.040 | 0.0018 | — | 2.3 | Comparative steel |

TABLE 14

| Steel No. | YP (kgf/mm²) | TS (kgf/mm²) | T-El (%) | r value | $r_{45}$ value | YP-El (%) | BH (Kgf/mm²) | Transition temp. (°C.) | Adhesion of plating | Concentration of Fe in plating | Remarks |
|---|---|---|---|---|---|---|---|---|---|---|---|
| 1 | 13 | 27 | 57 | 1.6 | 1.2 | 0 | 3.0 | −110 | 5 | 12% | Comparative steel |
| 2 | 15 | 29 | 50 | 1.9 | 1.7 | 0 | 0.5 | −100 | 5 | 10% | Steel of invention |
| 3 | 24 | 41 | 39 | 1.8 | 1.6 | 0 | 2.3 | −80 | 5 | 8% | Steel of invention |
| 4 | 23 | 39 | 42 | 1.8 | 1.6 | 0.3 | 5.5 | −35 | 5 | 6% | Comparative steel |

TABLE 15

| Steel No. | YP (kgf/mm²) | TS (kgf/mm²) | T-El (%) | r value | $r_{45}$ value | YP-El (%) | BH (kgf/mm²) | Transition temp. (°C.) | Remarks |
|---|---|---|---|---|---|---|---|---|---|
| 3 | 23 | 40 | 41 | 1.9 | 1.7 | 0 | 2.5 | −90 | Steel of invention |

Example 10

Conditions for cooling after the completion of hot rolling were studied using steels 2 and 3 specified in Table 13 by means of commercial equipment. The relationship between hot rolling conditions and r value and $r_{45}$ value of product sheets is shown in Table 16. In this case, cooling conditions after finishing, particularly the time taken until the initiation of rapid cooling and cooling rate were studied with respect to the hot rolling conditions. Cold rolling was carried out with a reduction ratio of 84%, and the sheet thickness was 0.8 mm. The steel sheet was then subjected to continuous annealing at 780° C. for 40 sec and temper rolling with a reduction ratio of 0.8%. As is apparent from Table 16, in the steel ingredients specified in the present invention, cooling within 0.5 sec after the completion of hot rolling to 750° C. or below at a cooling rate of not less than 50° C./sec is important to an improvement in r value, particularly $r_{45}$ value.

TABLE 16

| | Hot-rolling conditions | | | | | Property values for product sheet | | |
|---|---|---|---|---|---|---|---|---|
| Steel No. | SRT (°C.) | FT (°C.) | t (s) | CR (°C./s) | CT (°C.) | r value | $r_{45}$ value | Remarks |
| 2 | 1150 | 910 | 0.1 | 100 | 730 | 2.1 | 1.9 | Steel of invention |
| | 1150 | 910 | 0.3 | 20 | 730 | 1.7 | 1.2 | Comparative steel |
| | 1150 | 910 | 0.7 | 100 | 730 | 1.5 | 1.2 | Comparative steel |
| 3 | 1150 | 930 | 0.2 | 100 | 730 | 2.0 | 1.7 | Steel of invention |
| | 1150 | 930 | 0.4 | 20 | 730 | 1.7 | 1.2 | Comparative steel |
| | 1150 | 930 | 0.7 | 100 | 730 | 1.6 | 1.2 | Comparative steel |

Note) SRT: slab heating temp.; FT: finishing temp.; t: cooling initiation time after finishing; CR: cooling rate; and CT: coiling temp.

Example 11

Steels having compositions specified in Table 17 were prepared by the vacuum melt process on a laboratory scale. Specifically, in steels A (A-1 to A-5), the C content was varied on five levels in the range of from 0.0003 to 0.0030% with the P content being 0.050%. On the other hand, in steels B (B1 to B6), the P content was varied on six levels in the range of from 0.0002 to 0.04% with the C content being 0.0009%. Ingots having the above chemical compositions were hot-rolled under conditions of a slab heating temperature of 1150° C., a finishing temperature of 910° C. and a coiling temperature of 710° C. into steel sheets having a thickness of 4.0 mm. After pickling, cold rolling was effected with a reduction ratio of 80% to form cold-rolled steel sheets having a thickness of 0.8 mm. The cold-rolled steel sheets were heated to the maximum hating temperature 820° C. at a heating rate of 15° C./sec, cooled at a rate of about 10° C./see, subjected to conventional hot-dip galvanizing (Al concentration of bath: 0.1%) at 460° C., heated at 520° C. for 20 sec to effect an alloying treatment and cooled to room temperature at a rate of about 10° C./sec. The treated steel sheets were then subjected to temper rolling with a reduction ratio of 0.8% and subjected to a tensile test. The tensile test was carried out according to a method specified in JIS2241. The paint-bake hardenability (BH property) is the level of an increment of the yield point when the tensile test is again effected after a material, which has been prestrained 2% by tension, was subjected to a heat treatment corresponding to baking at 170° C. for 20 min.

Even when no Ti, Nb or other additive elements were added, if the total C content was 0.0018% or less, the elongation at yield point after heat treatment at 100° C. for one hr (YP-El) became 0.2% or less, so that a property of a non-aging at room temperature as the object of the present invention could be attained. Further, when the total C content was 0.0001% or more, it became possible to impart a BH property which was difficult to attain in extra low carbon steels containing Ti or Nb. When the amount of P added was 0.01% or more, the drawback of the extra low carbon steels containing neither Ti nor Nb, that is, low r value, particularly low $r_{45}$ value, was remarkably improved to such a level that the steel would suffice for use as a steel sheet for deep drawing.

TABLE 17

| Steel | Chemical composition (wt. %) | | | | | | | |
|---|---|---|---|---|---|---|---|---|
| No. | C | Si | Mn | P | S | Al | N | B |
| A1–A5 | 0.0003 to 0.0030 | 0.01 | 0.15 | 0.050 | 0.008 | 0.045 | 0.0012 | 0.0002 |
| B1–B6 | 0.0009 | 0.01 | 0.15 | 0.0002 to 0.04 | 0.008 | 0.045 | 0.0012 | 0.0002 |

Example 12

Based on the findings described in Example 11, steels having chemical compositions specified in Table 18 were prepared by the melt process on a commercial scale, cast and then subjected to hot rolling (heating temperature: 1200° C., finishing temperature: 930° C., coiling temperature: 710° C.), cold rolling (reduction ratio: 80%), continuous hot-dip galvanizing (maximum heating temperature: 820° C., hot-dip galvanizing: 460° C. (Al concentration of bath: 0.11%), alloying treatment: 520° C.×20 sec) and temper rolling (0.8%). A tensile test was effected in the same manner as that of Example 1. Further, evaluation of plating adhesion and measurement of the concentration of Fe in plating were carried out for evaluating the platability. The plating adhesion was evaluated in the same manner as that of Example 4.

The concentration of Fe in the plating was determined by X-ray diffractometry.

The fabricability was evaluated by subjecting the annealed steel sheet to punching to form disks, drawing the disks with a drawing ratio of 1.6 into cups, turning the cups, at various temperatures, over a tool in a truncated cone form, dropping a 300 kg weight from a height of 1 m on the cups to impact the cups and determining the ductility-embrittlement transition temperature if the cup was broken. In this case, when the ductility-embrittlement transition temperature was −20° C. or below, the fabricability was evaluated as good. The results are given in Table 19.

As is apparent from Table 19, according to the present invention, a non-aging at room temperature galvanized steel sheets for deep drawing, which are excellent in platability in hot-dip galvanizing and have a strength on a level in the range of from 30 to 45 kgf/mm$^2$, can be provided using steels containing no expensive elements such as Ti or Nb. At the same time, these room temperature at room temperature hot-dip galvanized steel sheets for deep drawing can also have a BH property. Further, it is apparent that addition of B in a very small amount contributes to a marked improvement in fabrication embrittlement resistance. In this connection, it is noted that steels 3-1 and 3-2, of which the strength had been increased by simultaneously adding P and Mn, had good r and $r_{45}$ values despite the fact that the Mn content was high. This suggests that simultaneous addition of P and Mn are useful also for grain refining of hot-rolled steel sheets.

TABLE 18

| Steel | Chemical Composition (wt. %) | | | | | | | |
|---|---|---|---|---|---|---|---|---|
| No. | C | Si | Mn | P | S | Al | N | B |
| 1-1 | 0.0004 | 0.03 | 0.15 | 0.03 | 0.008 | 0.060 | 0.0025 | 0.0003 |
| 1-2 | 0.0004 | 0.03 | 0.15 | 0.03 | 0.008 | 0.060 | 0.0025 | — |
| 2-1 | 0.0012 | 0.02 | 0.12 | 0.08 | 0.007 | 0.040 | 0.0018 | 0.0007 |
| 2-2 | 0.0012 | 0.02 | 0.12 | 0.08 | 0.007 | 0.040 | 0.0018 | — |
| 3-1 | 0.0009 | 0.10 | 0.7 | 0.06 | 0.010 | 0.054 | 0.0011 | 0.0005 |
| 3-2 | 0.0009 | 0.10 | 1.8 | 0.06 | 0.010 | 0.054 | 0.0011 | 0.0004 |

impurities, said fabrication embrittlement resistance of said steel sheet being a ductility-embrittlement transition temperature of −55° C. or below.

2. The ferritic single-phase cold-rolled steel sheet according to claim 1, wherein when the Mn content of said composition is in the range of from 0.2 to 3.0%, Mn and P have a relationship represented by the following formula:

$$Mn+20P \geqq 0.3 \text{ (\% by weight).}$$

3. The ferritic single-phase cold-rolled steel sheet according to claim 1, wherein said composition further comprises 0.1 to 3% by weight of Cr with Cr and P having a relationship represented by the following formula:

$$Cr+20P \geqq 0.2 \text{ (\% by weight).}$$

4. A non-aging at room temperature ferritic single-phase hot-dip galvanized steel sheet for deep drawing having excellent fabrication embrittlement resistance and paint-bake hardenability, comprising, in terms of % by weight, 0.0001 to 0.0015% of C, not more than 0.7% of Si, 0.03 to 3.0% of Mn, 0.01 to 0.15% of P, 0.0005 to 0.020% of S, 0.005 to 0.1% of Al, 0.0002 to 0.0080% of N and 0.0001 to 0.0030% of B with the balance consisting of Fe and

TABLE 19

| Steel No. | YP (kgf/mm²) | TS (kgf/mm²) | T-El (%) | r value | $r_{45}$ value | YP-El (%) | BH (kgf/mm²) | Transition temp. (°C.) | Adhesion of plating | Concentration of Fe in plating | Remarks |
|---|---|---|---|---|---|---|---|---|---|---|---|
| 1-1 | 18 | 33 | 47 | 1.6 | 1.4 | 0 | 2.1 | −90 | 5 | 12% | Steel of invention |
| 1-2 | 17 | 32 | 48 | 1.7 | 1.4 | 0 | 1.5 | −18 | 5 | 17% | Comparative steel |
| 2-1 | 22 | 39 | 43 | 1.8 | 1.5 | 0.1 | 5.0 | −70 | 5 | 8% | Steel of invention |
| 2-2 | 21 | 38 | 44 | 1.8 | 1.6 | 0.1 | 3.6 | −10 | 5 | 13% | Comparative steel |
| 3-1 | 22 | 41 | 39 | 1.6 | 1.4 | 0 | 3.9 | −70 | 5 | 9% | Steel of invention |
| 3-2 | 25 | 44 | 37 | 1.5 | 1.4 | 0.1 | 4.6 | −60 | 5 | 11% | Steel of invention |

Industrial Applicability

As is apparent from the above detailed description, according to the present invention, cold-rolled steel sheets, which are a non-aging at room temperature and have an excellent deep drawability, can be provided without adding expensive elements, such as Ti or Nb, and it is also possible to impart fabrication embrittlement resistance and paint-bake hardenability. Further, the present invention can also be applied to surface treating steel sheets for electroplating or hot dipping and a process for producing the same. Thus, the present invention enables steel sheets having excellent properties to be produced more economically and stably as compared with the prior art and, at the same time, can be expected to contribute to environmental protection through the utilization of high-strength steel sheets according to the present invention, so that the effect of the present invention is very significant.

We claim:

1. A non-aging at room temperature ferritic single-phase cold-rolled steel sheet for deep drawing having excellent fabrication embrittlement resistance and paint-bake hardenability, comprising, in terms of % by weight, 0.0001 to 0.0015% of C, not more than 1.2% of Si, 0.03 to 3.0% of Mn, 0.01 to 0.15% of P, 0.0010 to 0.020% of S, 0.005 to 0.1% of Al, 0.0001 to 0.0080% of N and 0.0001 to 0.0030% of B with the balance consisting of Fe and unavoidable unavoidable impurities, said fabrication embrittlement resistance of said steel sheet being a ductility-embrittlement transition temperature of −55° C. or below.

5. The ferritic single-phase hot-dip galvanized steel sheet according to claim 4, wherein when the Mn content of said composition is in the range of from 0.2 to 3.0%, Mn and P have a relationship represented by the following formula:

$$Mn+20P \geqq 0.3 \text{ (\% by weight).}$$

6. The ferritic single-phase hot-dip galvanized steel sheet according to claim 4, which further comprises 0.1 to 3% by weight of Cr with Cr and P having a relationship represented by the following formula:

$$Cr+20P \geqq 0.2 \text{ (\% by weight).}$$

7. A process for producing a non-aging at room temperature ferritic single-phase cold-rolled steel sheet for deep drawing having excellent fabrication embrittlement resistance and paint-bake hardenability, comprising the steps of:

heating a slab comprising, in terms of % by weight, 0.0001 to 0.0015% of C, not more than 1.2% of Si, 0.03 to 3.0% of Mn, 0.01 to 0.15% of P, 0.0010 to 0.020% of S, 0.005 to 0.1% of Al, 0.0001 to 0.0080% of N and 0.0001 to 0.0030% of B with the balance consisting of Fe and unavoidable impurities in the temperature range of from 1,150° to 1,350° C. and then hot-rolling the heated slab at a finishing temperature of not lower than ($Ar_3$—100)° C.;

cooling the hot-rolled coil provided by said hot rolling within 1 sec after said hot rolling at a rate of not lower than 50° C./sec from said finishing temperature to a temperature in the range of from 600° to 750° C. and coiling the cooled coil in said temperature ranges;

cold-rolling said hot-rolled coil with a reduction ratio of not lower than 60%; and subjecting the cold-rolled coil provided by said cold rolling to continuous annealing at a temperature in the range of from 600° to 900° C.;

thereby providing said steel sheet with said fabrication embrittlement resistance being a ductility-embrittlement transition temperature of −55° C. or below.

8. The process for producing a ferritic single-phase cold-rolled steel sheet according to claim 7, wherein after said hot rolling, the hot-rolled coil is cooled within 0.5 sec at a rate of not lower than 50° C./sec to a coiling temperature in the range of from 600° to 750° C.

9. The process for producing a ferritic single-phase cold-rolled steel sheet according to claim 7, wherein when said slab has a Mn content in the range of from 0.2 to 3.0%, Mn and P have a relationship represented by the following formula:

$$Mn+20P \geqq 0.3 \text{ (\% by weight).}$$

10. The process for producing a ferritic single-phase cold-rolled steel sheet according to claim 7, wherein said slab further comprises 0.1 to 3% by weight of Cr with Cr and P having a relationship represented by the following formula:

$$Cr+20P \geqq 0.2 \text{ (\% by weight).}$$

11. A process for producing a non-aging at room temperature ferritic single-phase hot-dip galvanized steel sheet for deep drawing having excellent fabrication embrittlement resistance and paint-bake hardenability, comprising the steps of:

heating a slab comprising, in terms of % by weight, 0.0001 to 0.0015% of C, not more than 0.7% of Si, 0.03 to 3.0% of Mn, 0.01 to 0.15% of P, 0.0005 to 0.020% of S, 0.005 to 0.1% of Al, 0.0002 to 0.0080% of N and 0.0001 to 0.0030% of B with the balance consisting of Fe and unavoidable impurities in the temperature range of from 1,150° C. to 1,350° C. and then hot-rolling the heated slab at a finishing temperature of not lower than ($Ar_3$—100)° C.;

cooling the hot-rolled coil provided by said hot rolling within 1 sec after said hot rolling at a rate of not less than 50° C./sec from said finishing temperature to a temperature in the range of from 500° to 750° C. and coiling the cooled coil in said temperature range;

cold-rolling said hot-rolled coil with a reduction ratio of not lower than 60%; and transferring the cold-rolled coil provided by said cold rolling to continuous hot-dip galvanizing equipment, where the cold-rolled coil is annealed in the temperature range of from 600° to 900° C. and then immersed in a hot-dip galvanizing bath to effect hot-dip galvanizing;

thereby providing said steel sheet with said fabrication embrittlement resistance being a ductility-embrittlement transition temperature of −55° C. or below.

12. The process for producing a ferritic single-phase hot-dip galvanized steel sheet according to claim 11, wherein after the cold-rolled steel strip is subjected to hot-dip galvanizing, the galvanized steel strip is heat-treated for alloying.

13. The process for producing a ferritic single-phase hot-dip galvanized steel sheet according to claim 11, wherein when the Mn content of said slab is in the range of from 0.2 to 3.0%, Mn and P have a relationship represented by the following formula:

$$Mn+20P \geqq 0.3 \text{ (\% by weight).}$$

14. The process for producing a ferritic single-phase hot-dip galvanized steel sheet according to claim 11, wherein when slab further comprises 0.1 to 3% by weight of Cr with Cr and P having a relationship represented by the following formula:

$$Cr+20P \geqq 0.2 \text{ (\% by weight).}$$

* * * * *

UNITED STATES PATENT AND TRADEMARK OFFICE

CERTIFICATE OF CORRECTION

PATENT NO. : 5,486,241 Page 1 of 2

DATED : January 23, 1996

INVENTOR(S) : Kohsaku USHIODA, et al.

It is certified that error appears in the above-indentified patent and that said Letters Patent is hereby corrected as shown below:

Column 2, line 66, change "When" to --when--.

Column 3, line 8, change "0,050%" to --0.050%--.

Column 7, line 20, after "hand," insert --when--.

Column 7, line 47, after "hand," insert --when--.

Column 10, line 13, change "rapid rolling" to --rapid cooling--.

Column 10, line 28 (in Table 4), change "condition" to --conditions--.

Column 12, line 9, change "maxim" to --maximum--.

Column 19, line 58, change "hating" to --heating--.

Column 19, line 59, before "820 " insert --of--.

Column 21, line 1, change "room temperature at room temperature" to --non-aging at room temperature--.

UNITED STATES PATENT AND TRADEMARK OFFICE

CERTIFICATE OF CORRECTION

PATENT NO. : 5,486,241

DATED : January 23, 1996

INVENTOR(S) : Kohsaku USHIODA, et al.

It is certified that error appears in the above-indentified patent and that said Letters Patent is hereby corrected as shown below:

Column 24,-line 39, change "when slab" to --said slab--.

Signed and Sealed this

Thirtieth Day of July, 1996

Bruce Lehman

*Attest:*

BRUCE LEHMAN

*Attesting Officer*

*Commissioner of Patents and Trademarks*